US005115585A

United States Patent [19]

Maldonado

[11] Patent Number: 5,115,585

[45] Date of Patent: May 26, 1992

[54] PHOTOGRAPH EXPOSING DEVICE

[76] Inventor: Duncan R. Maldonado, Yellowstone Y-1-4, Park Gardens, Rio Piedras, P.R. 00926

[21] Appl. No.: 586,139

[22] Filed: Sep. 21, 1990

Related U.S. Application Data

[63] Continuation-in-part of Ser. No. 271,678, Nov. 16, 1988, abandoned.

[51] Int. Cl.[5] ..... A47G 1/06

[52] U.S. Cl. ..... 40/152.2; 40/159

[58] Field of Search ..... 40/152.2, 159, 359, 40/584

[56] References Cited

U.S. PATENT DOCUMENTS 1,626,150 4/1927 Parda .
2,117,140 5/1938 Bowen .
3,286,382 11/1966 Newman .
4,320,591 3/1982 Dorman .

FOREIGN PATENT DOCUMENTS 2583965 1/1987 France ..... 211/13

*Primary Examiner*—Laurie K. Cranmer
*Attorney, Agent, or Firm*—Allen W. Wark

[57] ABSTRACT

A photograph exposing device for displaying photographs and the like in a practical and decorative manner is disclosed having a frame to which a plurality of swingable members or doors are attached. Each door includes a plurality of pockets in which photographs may be inserted therein. In addition, the photograph exposing device may have a generally concave configuration to provide a greater viewing angle for the photographs displayed therein. Accordingly, the photograph exposing device may be used by placing the selected photographs in the individual pockets and displayed in a practical and decorative manner.

11 Claims, 7 Drawing Sheets

PHOTOGRAPH EXPOSING DEVICE

CROSS-REFERENCE TO RELATED APPLICATION

This is a continuation-in-part of application Ser. No. 07/271,678, filed Nov. 16, 1988.

BACKGROUND OF THE INVENTION

The present invention relates generally to devices for displaying or exposing items and, specifically, to a photograph exposing device for displaying photographs and the like in a practical and decorative manner.

Devices for storing and displaying photographs are well known within the art and have had various forms and functions, for example, albums. However, albums have several problems and limitations associated with their use, including the inability to display the photographs and the inability to store a significant number of photographs. In contrast, the photograph exposing device of the present invention can permit the user to place all or most of their photographs taken over the years and currently hidden or kept in voluminous albums and display them in a practical and decorative manner.

Thus, there has been a need for a photograph exposing device which would eliminate the problems and limitations associated with the prior devices discussed above, most significant of the problems being the need to permit the user to display photographs in a practical and decorative manner. These and other objects will be apparent from the following detailed description and appended claims.

SUMMARY OF THE INVENTION

In contrast to the prior devices discussed above, it has been found that a photograph exposing device particularly suited for displaying photographs and the like in a practical and decorative manner can be constructed with a frame having a number of swingable members or doors secured to the frame by magnets as locks for the doors. The doors include a plurality of different size pockets positioned thereon for receiving and displaying at least one photograph in a pocket.

In the preferred embodiment, the frame is dimensioned to cover a substantial portion of an entire wall to provide a mural size photograph exposing device. Also, the photograph exposing device may include a optional lighting means for illuminating the swingable members or doors between each pocket.

In an alternative embodiment, the photograph exposing device of the present invention includes at least one acrylic wall size plate, with each plate containing numerous pockets to place photographs of different sizes. In addition, the photograph exposing device may be provided with a concave shape to facilitate easy viewing of any of the photographs displayed therein from any viewing angle. The photograph exposing device may be fixed to a wall or similar structure by screws and a tubular shape acrylic frame. Further, lighting may be provided to illuminate the photographs displayed in the photograph exposing device.

The photograph exposing device of the present invention for displaying a plurality of photographs and the like includes a frame, at least two swingable members, a plurality of pockets positioned about the swingable members and means for securing the swingable members to the frame so that the swingable members may be swung outwardly relative to the frame for inserting photographs into the pockets. The frame has a generally concave configuration. The pockets are positioned about the swingable members for receiving at least one photograph therein.

In the preferred embodiment, the frame is of sufficient size to cover a substantial portion of an entire wall of a house or other dwelling. The frame also includes a concave portion to facilitate the ease of view of photographs positioned in the pockets. In addition, means for securing each of the swingable members in a closed position is included. Further, the swingable members each include a plate of an optically transparent material such as acrylic.

Another embodiment of the photograph exposing device of the present invention for displaying a plurality of photographs and the like includes a frame, at least five swingable doors, a plurality of pockets positioned about the swingable doors and at least one organizing sheet. The swingable doors each have a generally concave configuration to facilitate viewing photographs contained therein. A photograph may be mounted to the organizing sheet and inserted into a pocket for displaying the photograph. Hinge means are provided for securing the swingable doors to the frame so that the swingable doors may be swung outwardly relative to the frame for inserting photographs into the pockets. In addition, magnetic means for securing each of the swingable doors in a closed position is provided.

In the preferred embodiment, the pockets include a canal to facilitate removal of a photograph or organizing sheet from the pocket.

BRIEF DESCRIPTION OF DRAWINGS

The various features, objects, benefits, and advantages of the present invention will become more apparent upon reading the following detailed description of the preferred embodiment along with the appended claims in conjunction with the drawing, wherein like reference numerals identify corresponding components, and:

DETAILED DESCRIPTION OF THE PREFERRED EMBODIMENT

The photograph exposing device of the present invention is illustrated in FIGS. 1–11 and is generally designated as 10.

The photograph exposing device 10 is a new gadget for the home or any business center whose principle qualities, i.e., practical and decorative, will make it indispensable in any place where one would "treasure memories" of what is done there and/or of the persons who live and/or work there.

Figure 1:
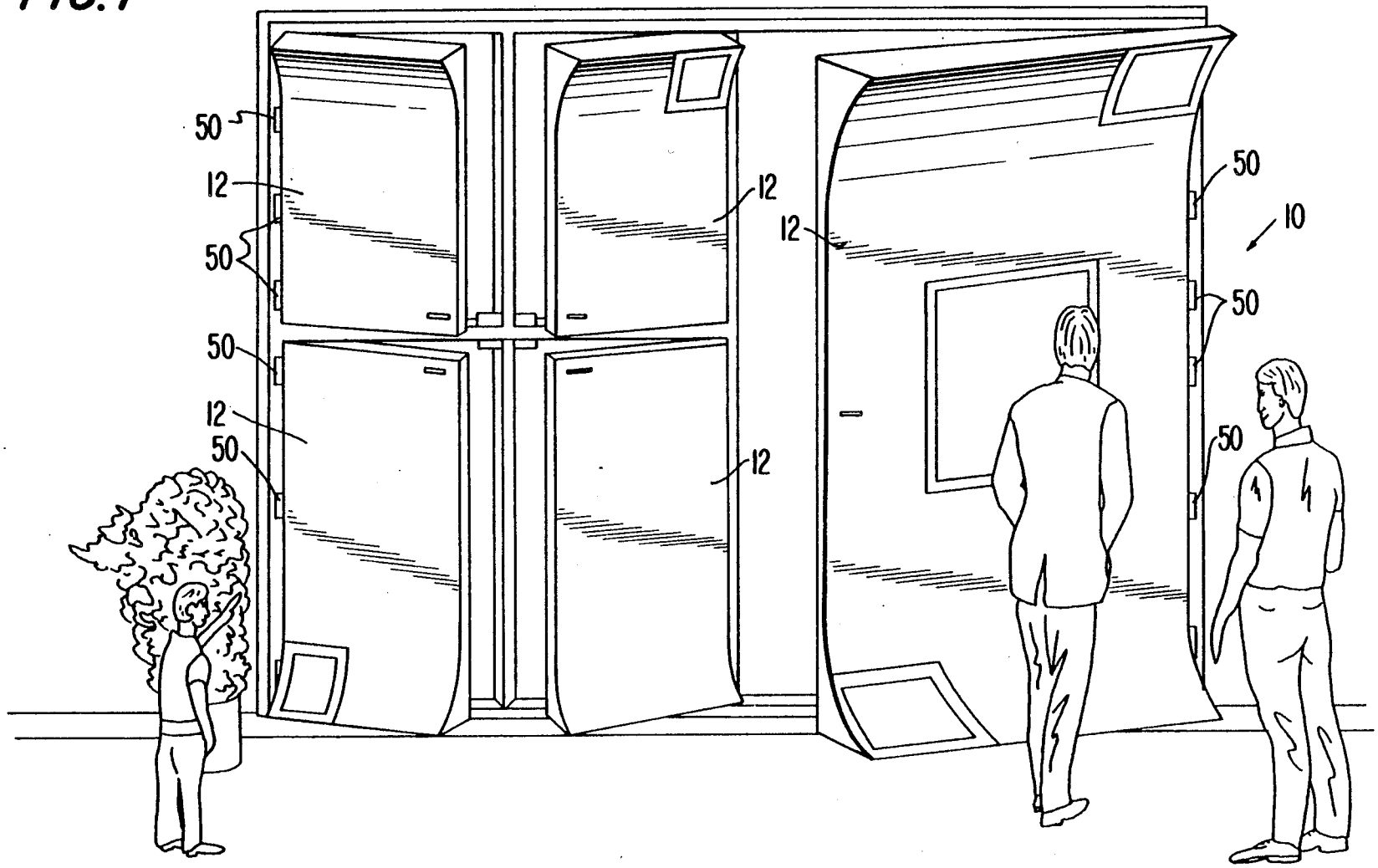
FIG. 1 is a schematic, front, perspective view of the photograph exposing device of the present invention having five swingable doors illustrated in an open position.
Figure 2A:
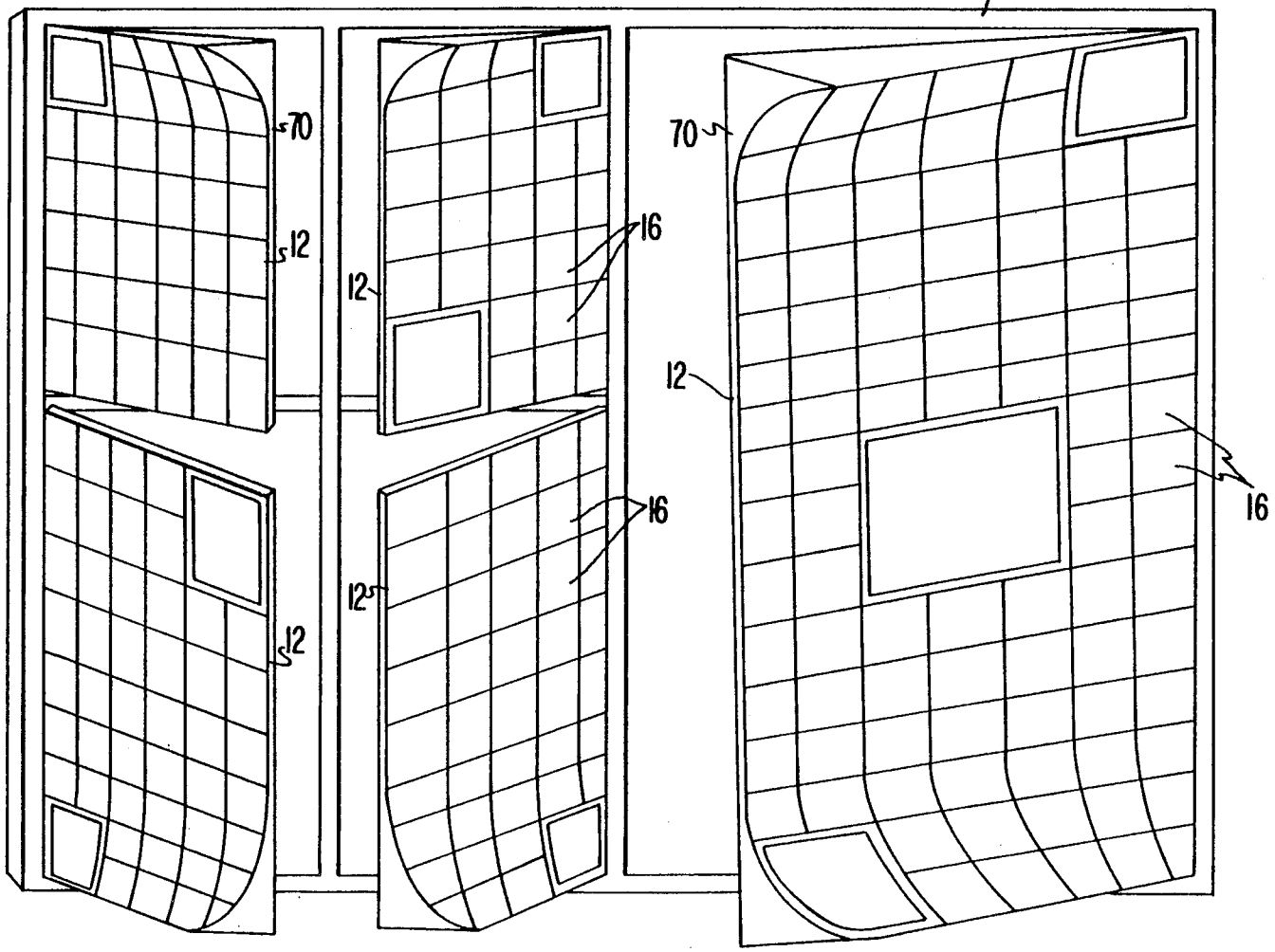
FIG. 2A is a front view of the photograph exposing device of the present invention having five swingable doors in an open position illustrating the pockets in which photographs may be placed.
Figure 2B:
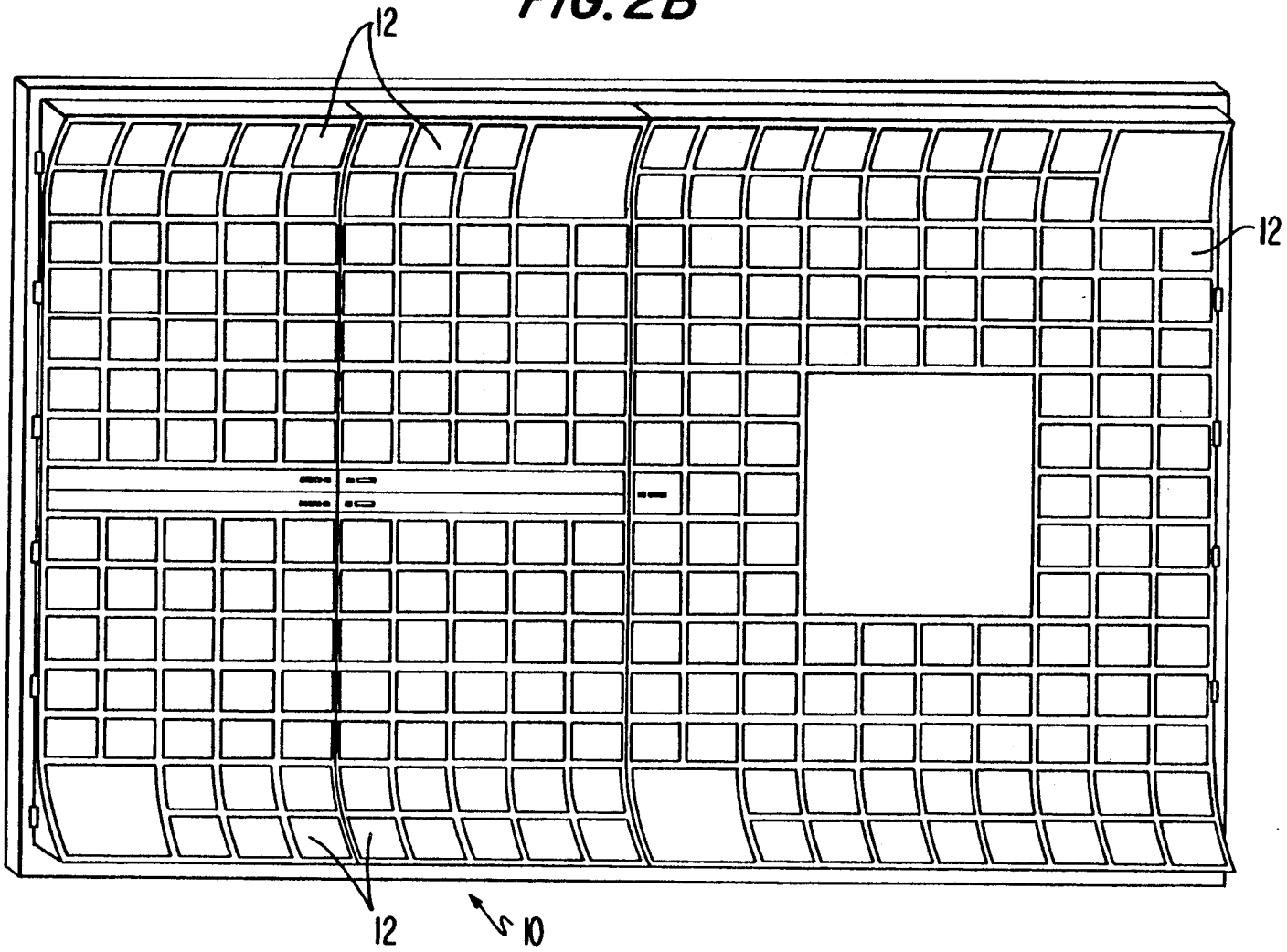
FIG. 2B is a front view of the photograph exposing device of the present invention having five swingable doors in a closed position illustrating the pockets in which photographs may be placed.

Referring to FIGS. 1 and 2A, the photograph exposing device 10 of the present invention includes a plurality of swingable members or doors 12, which may be closed as illustrated in FIG. 2B. Each of the various door may be locked or otherwise secured to the frame by a magnetic assembly 13 as illustrated in FIG. 1 to make them more discrete and more easily manageable.

As illustrated in FIG. 2A, the doors 12 are secured to a frame 14. Each door 12 includes a plurality of pockets 16 in which the user may place all or most of all the photographs that one has taken over the years and that are currently hidden or kept in voluminous albums.

Figure 4:
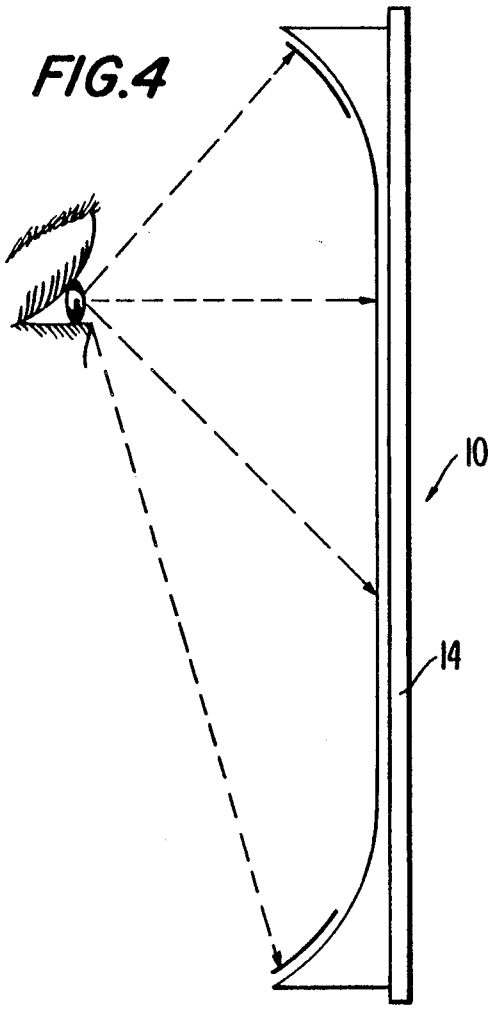
FIG. 4 is a schematic, side view of the photograph exposing device of the present invention illustrating viewing of photographs displayed therein.
Figure 3:
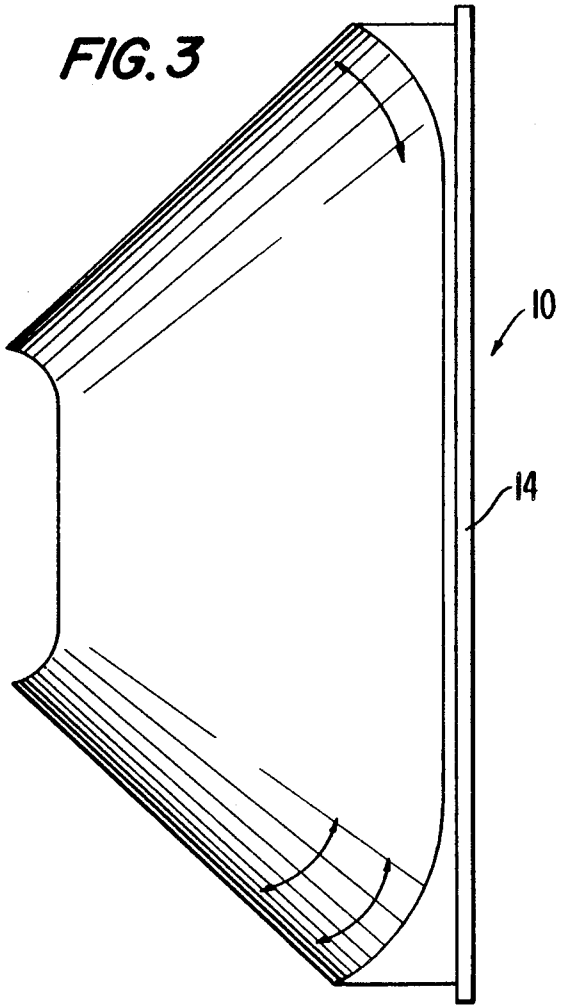
FIG. 3 is a side view of the photograph exposing device of the present invention illustrating the concave configuration to facilitate viewing of photographs displayed therein.

As emphasized in FIGS. 3 and 4, the photograph exposing device 10 of the present invention, preferably, includes a concave configuration to facilitate viewing of photographs displayed therein.

Figure 5A:
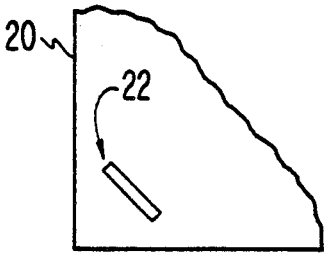
FIG. 5A is an enlarged, fragmentary view of the organizing sheet of the present invention illustrating a slit for holding photographs therein.
Figure 5:
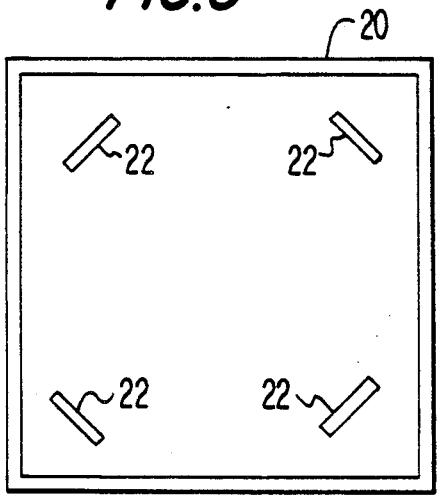
FIG. 5 is a front view of an organizing sheet of the present invention.

The photograph exposing device of the present invention may be available in various sizes, with the user being able to place photographs in a simple or multiple way. That is, by use of organizing sheets 20 shown in FIG. 5, and in greater detail in FIG. 5A, having slots 22 in which the edge of the photographs may be inserted. Specifically, the user can place a photograph in more ways than one and in the large and medium spaces, a user can place one or several photographs according to the particular preference of the user and the size of the organizing sheet.

Figure 6:
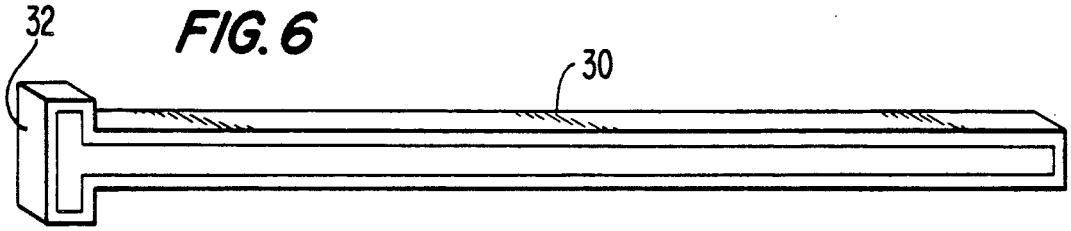
FIG. 6 is a perspective, plan view of a photo-handler to place or remove photographs.

As shown in FIG. 6, a photo-handler 30 may be used in order to facilitate placement or removal of the photographs or organizing sheets 20. The photo-handler may be provided with an upper part 32 which may be grooved and covered with a smooth material to avoid damage to the pockets 16.

Figure 8:
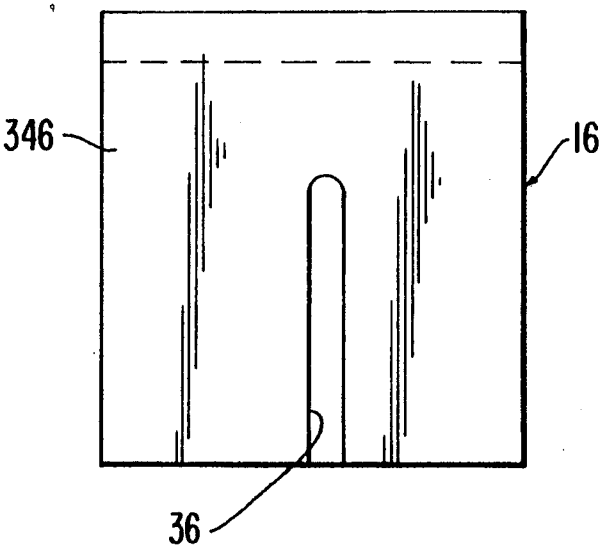
FIG. 8 is a plan view of the back side of the pocket.
Figure 7:
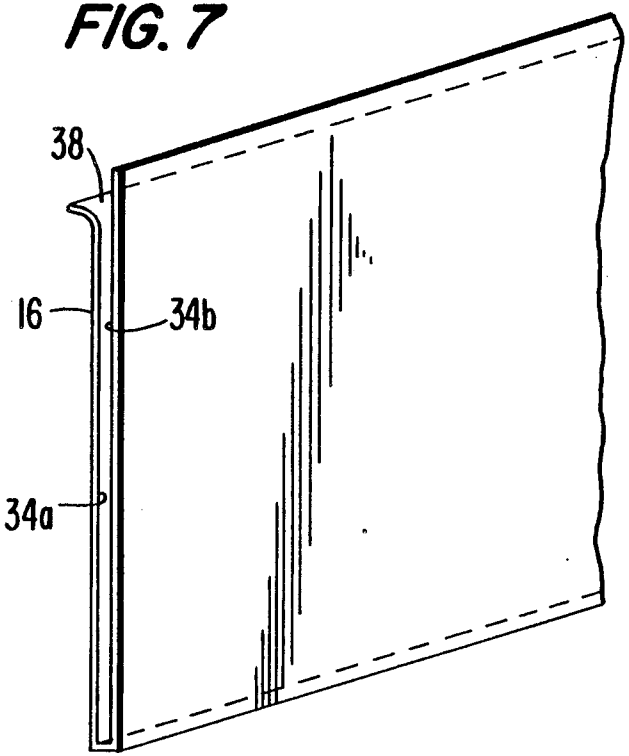
FIG. 7 is a side view of a pocket in which a photograph may be placed.
Figure 11:
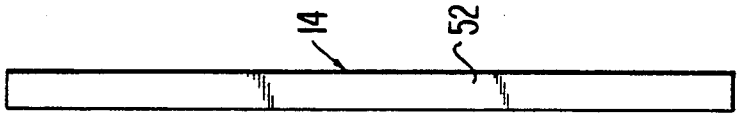
FIG. 11 is a side view of a tubular member of the frame of the photograph exposing device of the present invention

As shown in FIGS. 7 and 8, the pockets 16 may include a front wall 34*a* and a back wall 34*b* with a opening 38 provided at the top through which a photograph or organizing sheet may be inserted. As illustrated in FIG. 8, the back wall 34*a* of the pocket 16 includes a canal 36.

Figure 9:
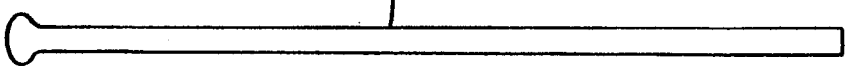
FIG. 9 is a plan view of a cleaner for the various pockets.

The photo-handler 30 will move vertically in the canal 36 and the opening 38 of the back inner wall 34*a* of the pocket 16. This canal will serve as access for a pocket cleaner 40, as shown in FIG. 9, which will be used to maintain the area clean in the each pocket 16.

Figure 10:
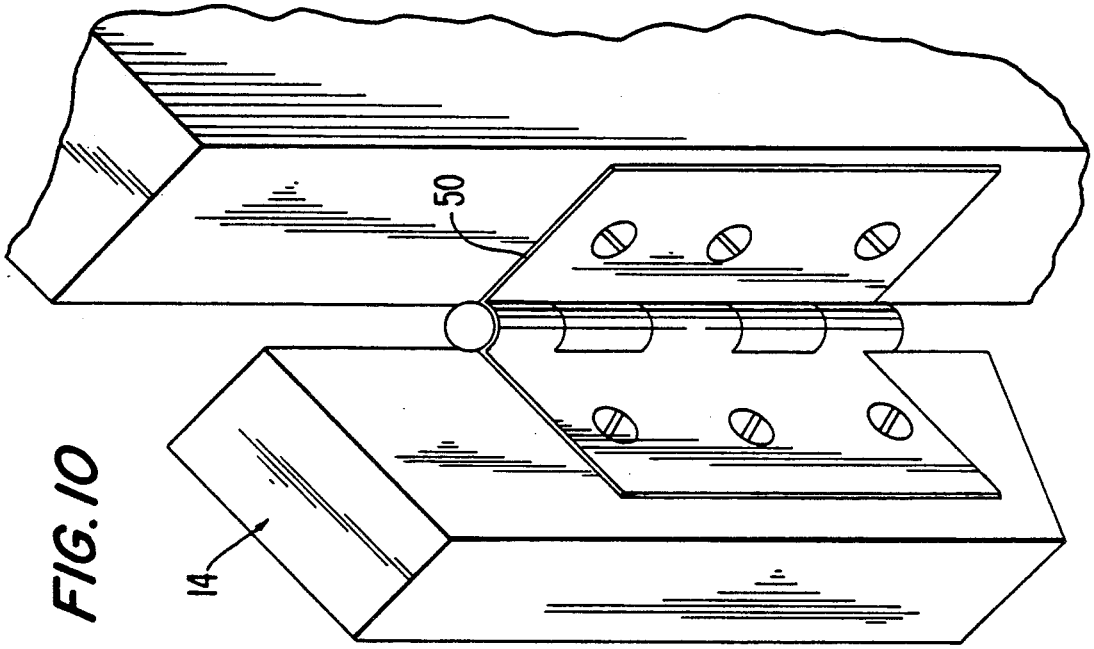
FIG. 10 is an enlarged, fragmentary view of the hinge for the swingable doors of the photograph exposing device of the present invention.

The various doors 12 may be sustained or secured on the frame 14 by hinges 50 as illustrated in FIGS. 1 and 2B, and in greater detail in FIG. 10. The frame 14 will preferably be attached to the wall by screws of a sufficient size depended upon the weight of the photograph exposing device 10 of the present invention. The frame 14 may be formed of tubular shaped members 52 of the type illustrated in FIG. 11.

The photograph exposing device 10 may include a pouch having a plurality of compartments, which may be placed in the interior of the photograph exposing device 10 for storing the photo-handler 30, the pocket cleaner 40 and other items used such as, for example, a cleaning cloth.

As an accessory, the photograph exposing device will be available with its own light 70 shown in FIG. 2A, which can also be used as a lamp. The internal lighting will be by wires and lights that will be disposed along the length and width of the spaces between the pockets of the photograph exposing device. Such lighting is commonly referred to as a neon lighting system or "rope lytes" and is commercially available from such companies as Exciting Lighting. However, as an alternative, direct lighting be used from, for example, ceiling spotlights.

The materials used for construction of the photograph exposing device 10 of the present invention may be transparent. The particular material of which the photograph exposing device 10 is made is not essential to the present invention and may be made from a variety of materials having, for example a transparent property such as acrylic since it is light-weight, economical and safer than crystal. In addition, the acrylic on which the photograph exposing device is constructed can be totally transparent-crystal or with soft tones of amber, aqua, pink, greenish or others.

The product can be manufactured by several manufacturing processes well known to those skilled in the art. Normally, the manufacturers of this product will select the best commercially available material, based upon price, application and manufacturing process.

In addition, it should be noted that the particular dimensions of the photograph exposing device are not intended to limit the present invention. However, it is preferred that the device be of sufficient size to cover a substantial portion of an entire wall, i.e., mural size, to display or exhibit different size photographs. Accordingly, the photograph exposing device of the present invention may be custom made or made in a variety of sizes such as large, medium, and small, in order to display various quantities of photographs depending upon the particular needs of the user. In addition, the size of the device can be adjusted to correspond to the dimensions of the wall to which it will be placed.

OPERATION AND USE

The photograph exposing device 10 of the present invention may be used to display photographs or the like in a practical and decorative manner. Specifically, a selected photograph may be inserted in any of the various pockets 16 and displayed therein.

In accordance with the above, the photograph exposing device 10 of the present invention is considered to be a new article (gadget) which may be used in almost any place in our contemporary world, in which human activities are carried out and where one will want to hold and display treasurable memories of these and its performers.

While the preferred embodiment of the present invention has been described so as to enable one skilled in the art to practice the device of the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A photograph exposing device for displaying a plurality of photographs and the like, comprising:
   a frame;
   at least two swingable members having a generally concave configuration;
   each of said swingable members including a plurality of pockets positioned on said swingable member for receiving at least one photograph therein; and
   means for securing the swingable members to said frame so that said swingable members may be freely swung while being used to display and store said plurality of photographs and the like outwardly relative to said frame to an open position and inwardly to a closed position and for inserting photographs into said pockets.

2. The photograph exposing device of claim 1, wherein said frame is of sufficient size to cover a substantial portion of an entire wall of a house or other dwelling.

3. The photograph exposing device of claim 1, further comprising means for securing each of the swingable members in a closed position.

4. The photograph exposing device of claim 1, wherein said frame includes a concave portion to facilitate the ease of view of photographs positioned in said pockets.

5. The photograph exposing device of claim 1, wherein said swingable members each include a plate of an optically transparent material.

6. A photograph exposing device for displaying a plurality of photographs and the like, comprising:
   a frame;
   at least five swingable doors having a generally concave configuration to facilitate viewing photographs contained therein;
   a plurality of pockets positioned on said swingable doors in which photographs may be inserted for storing and viewing; at least one organizing sheet to which at least one photograph may be mounted so that said organizing sheet may be inserted into a pocket for displaying said photograph;
   hinge means for securing the swingable doors to said frame so that said swingable doors may be swung outwardly relative to said frame for inserting photographs into said pockets;
   magnetic means for securing each of the swingable doors in a closed position.

7. The photograph exposing device of claim 6, wherein said frame is of sufficient size to cover a substantial portion of an entire wall of a house or other dwelling.

8. The photograph exposing device of claim 6, wherein said pocket includes a canal to facilitate removal of a photograph or organizing sheet from said pocket.

9. The photograph exposing device of claim 6, wherein said frame includes a concave portion to facilitate the ease of view of photographs positioned in said pockets.

10. The photograph exposing device of claim 6, wherein said swingable doors each include a plate of an optically transparent material.

11. The photograph exposing device of claim 10, wherein said transparent material is acrylic.

* * * * *